United States Patent [19]

Breen

[11] 4,259,923

[45] Apr. 7, 1981

[54] REVERSE SPRAY ELECTROSTATIC AIR/POWDER STRIPE APPLICATOR

[75] Inventor: Joseph R. Breen, Alsip, Ill.

[73] Assignee: The Continental Group, Inc., Stamford, Conn.

[21] Appl. No.: 138,628

[22] Filed: Apr. 8, 1980

Related U.S. Application Data

[63] Continuation-in-part of Ser. No. 936,545, Aug. 23, 1978, abandoned.

[51] Int. Cl.[3] ..... B05B 5/02; B05C 19/00; B05C 7/02

[52] U.S. Cl. ..... 118/622; 118/306; 118/308; 118/DIG. 10

[58] Field of Search ..... 118/308, 301, 317, 622, 118/DIG. 10, 306, 630; 427/181, 197; 51/411, 439

[56] References Cited

U.S. PATENT DOCUMENTS

| | | | |
|---|---|---|---|
| 2,358,557 | 9/1944 | Boyd et al. | 51/411 |
| 2,513,289 | 7/1950 | Crom | 118/317 X |
| 3,311,085 | 3/1967 | Smith | 118/301 X |
| 3,526,027 | 9/1970 | Manuel et al. | 118/317 X |
| 3,678.336 | 7/1972 | Winkless | 118/630 X |
| 4,098,226 | 7/1978 | Furter | 118/630 X |

*Primary Examiner*—John P. McIntosh
*Attorney, Agent, or Firm*—Charles E. Brown

[57] ABSTRACT

A powder applicator for applying powder in a stream to side seams of container bodies. The powder is directed towards an associated nozzle entrained in a carrier gas. However, as the gas entrained powder approaches the nozzle, it passes through a centrifuge section of the supply tube wherein the powder is separated from the gas and is directed against a radially outer portion of a return bend which extends through an arc on the order of 180°. As a result, the powder is directed to the orifice of the nozzle as a continuous dense stream with the gas being in a layered relation with respect to the powder.

10 Claims, 4 Drawing Figures

REVERSE SPRAY ELECTROSTATIC AIR/POWDER STRIPE APPLICATOR

This is a continuation-in-part of my copending application Ser. No. 936,545, filed Aug. 23, 1978, now abandoned.

This invention relates in general to new and useful improvements in the interior side striping of container bodies, and more particularly to a novel powder applicator.

There has been recently developed a powder applicator wherein there is incorporated in the powder spray pipe a centrifuge arrangement which causes the powder to flow into one cross-sectional segment of the pipe, separating the powder from the carrier gas, and thereby distributing the powder to a nozzle orifice in a preselected segment only of that orifice for application of the powder in a stream. This development, while beneficial, is thought to have two deficiencies. First, when using a 360° loop as is required with the prior centrifuge arrangement, the orifice must be directed in the same direction as the movement of the can bodies past the nozzle. Secondly, a friction drop or loss in the powder supply tube is reduced while the desired centrifuge action is obtained.

In addition, inasmuch as the can bodies with the powder stripe applied thereto are heated and the heat source is a gas flame, fire can result when the powder is directed in the direction of can body movement.

In accordance with this invention, it is proposed to utilize the centrifuge principles while at the same time reversing the direction of powder flow so that it opposes the direction of movement of the can bodies. In making this change, it has been found that the necessary centrifuge action can be obtained with a reverse bend of generally 180° spray loop. Further, it has been found that the friction loss within the loop is reduced and that a better flow of the powder stream can be effected.

Further, it has been found that by directing the powder stream in general opposition to the direction of movement of the can bodies, the film or powder weight variation along the side seam is less. There is a slight decrease in powder thickness at the "lead" edge of the can body, but the decrease in powder thickness is less than the "tail off" decrease using a conventional spray applicator.

Prior devices other than that discussed above have been provided for interiorly side striping can bodies and the like including the patent to Manuel et al U.S. Pat. No. 3,526,027 granted Sept. 1, 1970, and the patent to Winkless U.S. Pat. No. 3,678,336 granted July 18, 1972.

With the above and other objects in view that will hereinafter appear, the nature of the invention will be more clearly understood by reference to the following detailed description, the appended claims, and the several views illustrated in the accompanying drawings.

Figure 1:
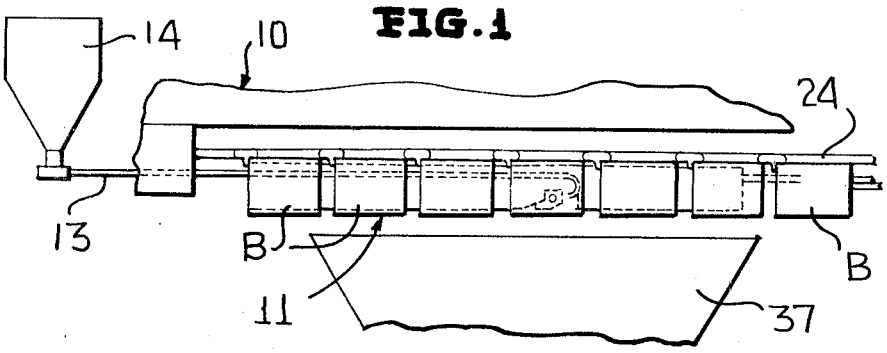
FIG. 1 is a schematic side elevational view of a body maker having incorporated therein a powder applicator in accordance with this invention.

Referring now to FIG. 1, it will be seen that there is illustrated a body maker 10 which may be of a conventional type, but in accordance with the illustrated form of can body is one which forms can bodies with welded side seams. The body maker has attached to the horn thereof in a conventional manner a powder applicator, generally identified by the numeral 11. The powder applicator 11 includes a suitable support, generally identified by the numeral 12, which forms a continuation of the horn and which may function as a support for can bodies, although the can bodies could equally as well be carried by external supports.

Figure 2:
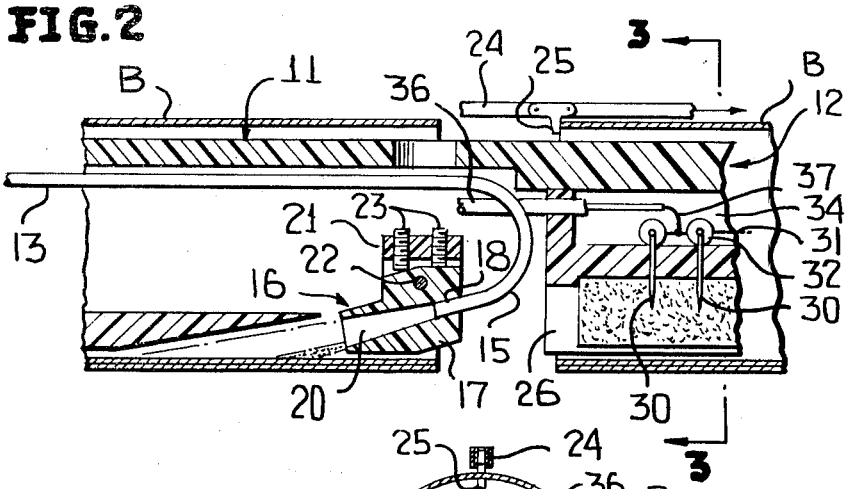
FIG. 2 is an enlarged fragmentary longitudinal vertical sectional view taken through the powder applicator and shows the general details thereof.

The support 12 has extending into the lead end thereof a powder supply line 13 which is suitably connected, as shown in FIG. 1, to a powder dispenser 14 wherein powder is entrained in a suitable carrier gas which may be air. The carrier gas entrained powder is directed through the spray tube 13 into the interior of the support through the body maker 10 until it reaches a position adjacent the desired location of powder application, as is best shown in FIG. 2. The supply tube 13 is provided with a centrifuge section 15 in the form of a reverse bend which extends through an arc on the order of 180°.

It is to be understood that the radius of curvature of the reverse bend which forms the centrifuge section 15 is such that when related to the velocity of the carrier gas entrained powder, the powder will be thrown outwardly against the radial outer wall of the tube, and thus there will be effected a layering or stratifying action with the powder becoming a dense stream separate and apart from the carrier gas.

The supply tube 13 terminates in a nozzle generally identified by the numeral 16. Basically, the nozzle 16 is in the form of a block having a bore 18 opening through one face thereof and receiving the terminal end of the supply tube 13. The bore 18 opens into an orifice 20 which has a longitudinal axis selectively disposed at a slight angle to the path of movement of can body side seams or substantially parallel thereto. It is to be understood that the powder stream is concentrated in the lower part of the orifice 20 which is preferably of an expanded configuration as shown in FIG. 2.

The block 17 is mounted on an inverted U-shaped support 21 by means of a transverse pivot pin 22. The support 21 has adjustably mounted on the central portion thereof adjusting screws 23 through which the tilting of the orifice 20 is controlled, and the orifice 20 is maintained in a selected angular relation with respect to the path of movement of can bodies.

As will be readily apparent, as can bodies B, which are moved in spaced sequence along the predetermined path by a conveyor chain 24 having lugs 25, move past the nozzle 16, a dense stream of powder is directed onto the side seam area of each can body B as is diagrammatically shown. Since the powder is applied in a dense stream, and is for the most part not conveyed by the carrier gas, it flows onto the can bodies in the same general manner as a liquid with a minimum of overspray and powder particle bounce.

It is to be understood that the powder particles are to be electrostatically charged so that they will remain in position on the interior surface of the can bodies as the can bodies pass further down the can line and are subjected to heating to a temperature which will effect fusing of the powder particles. To this end, downstream of the nozzle 16, the support 12 is provided with an elongated opening or channel 26 of a cross section best shown in FIG. 3. The channel 26 carries a pair of elongated plates 27 which define side walls of a sealed chamber defined between a pair of brushes 28 carried by the support 12 and internally engaging the can bodies on opposite sides of the side seam area.

The sealed area has projecting therethrough a longitudinal line of corona charging pins 30 which effectively charge the powder particles which have passed into the sealed area. The corona charging pins 30 are connected to a common source of high voltage d.c. current by a conductor 31 with there being a resistor 32 between each charging pin 30 and the conductor 31 so as to provide for uniform current distribution among the line of charging pins.

It is to be understood that the channel 26 will be of sufficient length so as to permit an adequate charging of the powder particles disposed within the sealed area so that all of the particles will adhere to the interior surface of the can body B, preferably along the side seam area. The side seam area will later be heated in a conventional manner to effect fusing of the powder particles to the can body, thereby preventing the existence of any powder particle which is so adhered to the interior of the can body whereby it may later become disengaged and become either a contaminant for food products or foreign matter which could plug the spray dispensing mechanism should the can body be part of an aerosol container.

Figure 3:
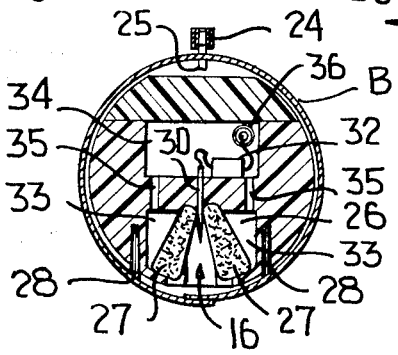
FIG. 3 is a transverse vertical sectional view taken generally along the line 3—3 of FIG. 2.

It is to be understood that the porous plates 27 define, together with the support 12, exteriorly of the sealed area chambers 33. The chambers 33 are disposed within a channel 34 formed in the upper part of the support 12 and carrying the conductor 31 and the resistors 32. The channel 34 opens into the chambers 33 through passages 35, as is shown in FIG. 3.

A suitable gas (air) is directed into the channel 34 through a spray tube 36 which extends through the body maker horn in the same manner as the spray tube 13. The tube 36 also carries a lead conductor 37 for supplying the electrical energy to the conductor 31.

The gas (air) entering into the channel 34 passes into the chambers 33 and through the plates 27 so that diffused gas serves to keep clean the sides of the sealed chamber as well as the corona charging pins 30.

If desired, there may also be provided a hopper 37 for receiving excess powder. The hopper 37 will extend below the path of travel of the can body as shown in FIG. 1, and be positioned for receiving particles which exit from the nozzle 16 between can bodies. A vacuum may be drawn in the hopper 37 so as to aid in drawing out any loose powder particles which may exist.

Figure 4:
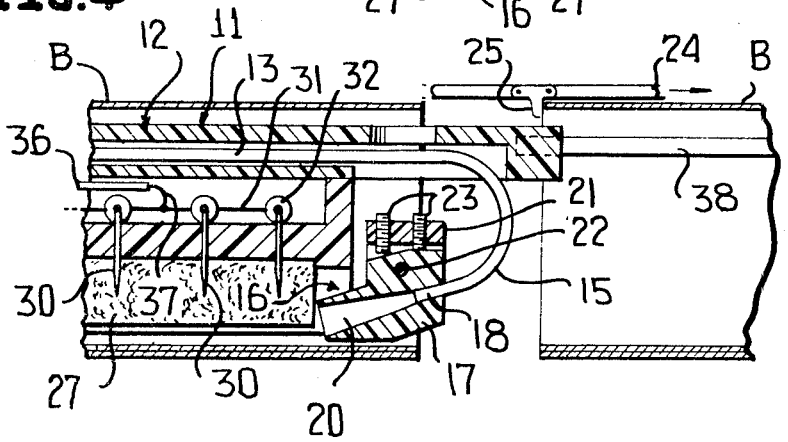
FIG. 4 is a fragmentary longitudinal vertical sectional view similar to FIG. 2, but illustrating a preferred embodiment of the invention.

In the embodiment illustrated in FIG. 2, the powder charging mechanism is disposed downstream of the nozzle 16. It has been found, however, that it is best to provide the charging mechanism upstream of the nozzle 16, as is illustrated in FIG. 4. Although only a portion of the charging mechanism has been illustrated, it is to be understood that the charging mechanism will be of a longitudinal extent so as to take care of all possible powder flow and thereby eliminate the possibility of uncharged, loose powder existing within the can body.

Inasmuch as the support 12 is foreshortened in the embodiment of FIG. 4, support or guide bars 38 which guide the coated can bodies downstream of the coating apparatus are illustrated as being directly coupled into the support 12.

It is to be understood that the reverse bend in the supply tube 13 and the mounting of the nozzle 16 so as to direct a powder stream in opposition to the direction of movement of the articles being coated may be utilized in other environments.

Although only a preferred embodiment of the invention has been specifically illustrated and described herein, it is to be understood that minor variations may be made in the powder applicator without departing from the spirit and scope of the invention as defined by the appended claims.

I claim:

1. A powder applicator for internally striping side seams of tubular bodies, said powder applicator comprising support means for supporting tubular bodies for movement along a predetermined path, a fixed discharge nozzle having an orifice for directing powder in a controlled straight line stream, a supply line carried by said support means and for directing gas entrained powder towards said nozzle, said supply line having adjacent said nozzle means for de-entraining the powder and effecting the supplying of the gas and the powder in separate layers to said nozzle with the powder being concentrated in a preselected sector of said nozzle for effecting the discharge of the powder in a dense stream, said means being a reverse turn in said supply line, said orifice opening generally in opposition to the direction of travel of said tubular bodies along said path of movement, said nozzle and said supply line including said reverse turn being disposed within said predetermined path, and electrostatic charging means within said path adjacent said nozzle for charging discharged powder to retain the powder in place on said tubular bodies.

2. The powder applicator of claim 1 wherein said reverse turn extends through an arc on the order of 180°.

3. The powder applicator of claim 2 wherein said support means is of a size for receiving tubular bodies having a diameter on the order of 2.5 to 3.0 inch.

4. The powder applicator of claim 1 wherein said support means carries adjacent said nozzle sealing means for engaging the interior of a tubular body on opposite sides of the portion of the body to be coated and forming a confined area within which discharged powder may flow.

5. The powder applicator of claim 4 together with means for supplying diffused gas into said confined area for maintaining floating powder particles in suspension.

6. The powder applicator of claim 4 together with means for supplying diffused gas into said confined area for maintaining floating powder particles in suspension, and said electrostatic charging means being operable for charging said floating powder particles and effecting the directing hereof towards tubular body side seams.

7. The powder applicator of claim 4 wherein said electrostatic charging means and said sealing means are downstream of said path from said nozzle.

8. The powder applicator of claim 4 wherein said electrostatic charging means and said sealing means are upstream of said path from said nozzle.

9. The powder applicator of claim 1 wherein said electrostatic charging means are downstream of said path from said nozzle.

10. The powder applicator of claim 1 wherein said electrostatic charging means are upstream of said path from said nozzle.

* * * * *